US007300133B1

(12) United States Patent
Folkins et al.

(10) Patent No.: US 7,300,133 B1
(45) Date of Patent: Nov. 27, 2007

(54) SYSTEMS AND METHODS FOR PRINT HEAD DEFECT DETECTION AND PRINT HEAD MAINTENANCE

(75) Inventors: Jeffrey J. Folkins, Rochester, NY (US); Donald J. Drake, Rochester, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 11/830,673

(22) Filed: Jul. 30, 2007

Related U.S. Application Data

(62) Division of application No. 10/953,527, filed on Sep. 30, 2004, now Pat. No. 7,264,328.

(51) Int. Cl.
*B41J 29/393* (2006.01)
*B41J 29/38* (2006.01)

(52) U.S. Cl. ..... 347/19; 347/9

(58) Field of Classification Search ..... 347/19
See application file for complete search history.

(56) References Cited

U.S. PATENT DOCUMENTS 5,160,938 A * 11/1992 Fargo et al. ..... 347/19
5,583,552 A 12/1996 Mutoh
5,600,352 A 2/1997 Knierim et al.
5,871,292 A * 2/1999 Johnson et al. ..... 347/37
6,076,922 A 6/2000 Knierim
6,113,231 A 9/2000 Burr et al.
6,227,644 B1 5/2001 Perner
6,325,480 B1 12/2001 Moghadam et al.
6,394,577 B1 5/2002 Wen et al.
6,467,867 B1 10/2002 Worthington et al.
6,637,853 B1 10/2003 Ahne et al.
6,752,493 B2 6/2004 Dowell et al.
6,985,250 B2 1/2006 Folkins
2001/0031148 A1* 10/2001 Kajiwara et al. ..... 347/19
2003/0202073 A1* 10/2003 Dowell et al. ..... 347/89

* cited by examiner

*Primary Examiner*—Matthew Luu
*Assistant Examiner*—Jannelle M. Lebron
(74) *Attorney, Agent, or Firm*—Oliff & Berridge, PLC

(57) ABSTRACT

A method for detecting a defect in an inkjet print head within an inkjet marking device includes marking images on a rotating intermediate substrate according to an image sequence, marking a test image on at least one blank portion of the intermediate substrate, the blank portion resulting from the image sequence, evaluating the test image with a sensor, and determining whether the inkjet print head is defective based on the evaluation.

14 Claims, 7 Drawing Sheets

IMAGE #
DRUM REV #
PITCH A OR B
TRANSFER
A1 X A2 B1 A3 B2 A4 B3 A1 B4 A2 X o X o X A3 B1 A4 B2 A1 B3 A2 B4 A3 B1 A4 B2 X o X B3 A1 B4 A2
REV 1 REV 2 REV 3 REV 4 REV 5 REV 6 REV 7 REV 8 REV 9 REV 10 REV 11 REV 12 REV 13 REV 14 REV 15 REV 16 REV 17
A B A B A B

SYSTEMS AND METHODS FOR PRINT HEAD DEFECT DETECTION AND PRINT HEAD MAINTENANCE

This is a Divisional Application of U.S. patent application Ser. No. 10/953,527, filed Sep. 30, 2004 now U.S. Pat. No. 7,264,328. The entire disclosure of the prior application is hereby incorporated by reference herein in its entirety.

BACKGROUND OF THE INVENTION

1. Field of Invention

This invention relates to systems and methods for print head defect detection and print head maintenance.

2. Description of Related Art

There exists printers wherein an inkjet print head moves relative to and ejects marking material toward an intermediate substrate in order to form an image on the intermediate substrate. Subsequently, the image is transferred from the intermediate substrate onto a sheet of media. The quality of the image formed on the sheet of media is influenced by, among other things, the positioning of the inkjets within the inkjet print head and the ability for the inkjets to consistently eject ink.

For example, inkjets within the inkjet print head can become clogged. The inkjets can also become misaligned such that ink is not consistently ejected in the same direction. Solid inkjet print heads are prone to randomly develop defects such as clogged or misaligned jets. Once an inkjet becomes defective, it will remain defective until the defects are corrected. In other words, the defects that exist in the inkjets and inkjet print heads are semi-stable because they do not self correct over time. Typically, some maintenance is required in order to correct the inkjets and/or inkjet print heads. The defect will thus remain with the inkjet head until some maintenance is performed. The maintenance may include a purging operation or a realignment of the inkjet heads.

Conventionally, in order to determine whether one or more inkjets is defective, an image is printed on a sheet of media and the image is visually inspected in order to detect defects in the inkjets and/or print heads. If the image contained defects, a user could then initiate print head maintenance. However, printing a separate test image and manually initiating maintenance is both system resource (e.g., media, ink, and time that might otherwise be used for productive output) and user resource (e.g., time required to initiate test image, review test image, and initiate maintenance) intensive.

Xerographic devices have addressed the problem of wasted system and user resources by printing test images onto a photoconductive (intermediate) substrate within inter-document zones. When images are laid down on the photoconductive substrate in xerographic devices, based on the typical system architecture, there is sufficient space between those images on the photoconductive substrate to print a test image between the images to be printed. By using an internal image sensor, the xerographic device can evaluate the test image for defects or unintended variations and then perform maintenance on the appropriate subsystem.

SUMMARY OF THE INVENTION

Inkjet defects are typically caused by an amount of material clogging or partially clogging the defective jet. When an inkjet is clogged or partially clogged, the clog may influence, for example, drop mass, drop velocity, and/or drop direction. Print heads may become defective as the mechanical, timing, image alignment, and registration attributes of the print head vary with time and usage. Inkjet and print head defects require occasional readjustment. For the purpose of this disclosure an inkjet print head will be considered defective if at least one inkjet within that print head is defective.

In an attempt to detect defective print heads and inkjets, the general concept of an Image on Drum (IOD) sensor has been proposed to allow a machine to measure the various defects or variations (e.g., clogged inkjets and or misalignment of inkjets and/or print heads) and self-compensate. An IOD sensor is a sensor configured to monitor, for example, the presence, intensity, and/or location of marking material jetted on the intermediate substrate by the inkjets of the print heads. An IOD sensor could generally include, for example, a light source and one or more optical detectors situated to detect marking material on the intermediate substrate.

As a result, a user would not have to manually evaluate a test image and manually input correction values or manually initiate print head maintenance procedures. However, simply providing basic inkjet/print head defect detection with an IOD as a standalone procedure does not provide the most efficient system solution since the defect detection procedure takes time, consumes ink and utilizes other precious systems resources if invoked too often.

System resources are wasted because the timing and drum size in a multi-pass inkjet device are generally configured so that all regions in an inter-document zone on an intermediate substrate come into contact with the transfer roller. A transfer roller applies pressure to the back of a sheet of media as the sheet of media is transported between the intermediate substrate and the transfer roller. Inter-document areas are areas on the intermediate substrate between the areas on which images to be transferred to sheets of media are printed.

Test images marked onto the intermediate substrate in an inter-document zone would be subsequently transferred to the transfer roller, since no sheet of media comes into contact with the intermediate substrate in an inter-document zone. Because the image is transferred to the transfer roller, when the next sheet of media is transported between the intermediate substrate and the transfer roller, the image on the transfer roller would be transferred onto the back side of that sheet of media. Accordingly, test images must be marked on the intermediate substrate during a test cycle independent of a print job. As a result, system resources that are dedicated to the independent test cycle are wasted (i.e., cannot be utilized for print cycles).

Accordingly, various exemplary embodiments of this invention test for defective inkjet print heads and inkjets and allow for the correction of the defective inkjet print heads and inkjets while minimizing wasted system and user resources.

Various exemplary embodiments of the invention provide a method for detecting a defect in an inkjet print head, including marking images on a rotating intermediate substrate according to an alternate image sequence; marking a test image on at least one blank portion of the intermediate substrate, the blank portion resulting from the alternate image sequence; evaluating the test image with a sensor; and determining whether the inkjet print head is defective based on the evaluation.

Various exemplary embodiments of the invention provide a method for detecting a defect in an inkjet print head, including marking images on a rotating intermediate substrate according to a consecutive image sequence; marking a test image on at least one blank portion of the intermediate substrate, the blank portion resulting from the consecutive image sequence; evaluating the test image with a sensor; and determining whether the inkjet print head is defective based on the evaluation.

Various exemplary embodiments of the invention provide a system for detecting a defect in an inkjet print head, including at least one controller that causes at least one inkjet to mark images on a rotating intermediate substrate according to an alternate image sequence; causes the at lest one inkjet to mark a test image on at least one blank portion of the intermediate substrate, the blank portion resulting from the alternate image sequence; causes a sensor to input the test image; and determines whether at least one of the at least one inkjet is defective based on the input test image.

Various exemplary embodiments of the invention provide a system for detecting a defect in an inkjet print head, including at least one controller that causes at least one inkjet to mark images a rotating intermediate substrate according to a consecutive image sequence; causes the at least one inkjet to mark a test image on at least one blank portion of the intermediate substrate, the blank portion resulting from the consecutive image sequence; causes a sensor to input the test image; and determines whether at least one of the at least one inkjets is defective based on the input test image.

BRIEF DESCRIPTION OF THE DRAWINGS

Exemplary embodiments of the invention will now be described with reference to the accompanying drawings, wherein.

DETAILED DESCRIPTION OF EXEMPLARY EMBODIMENTS

Figure 1:
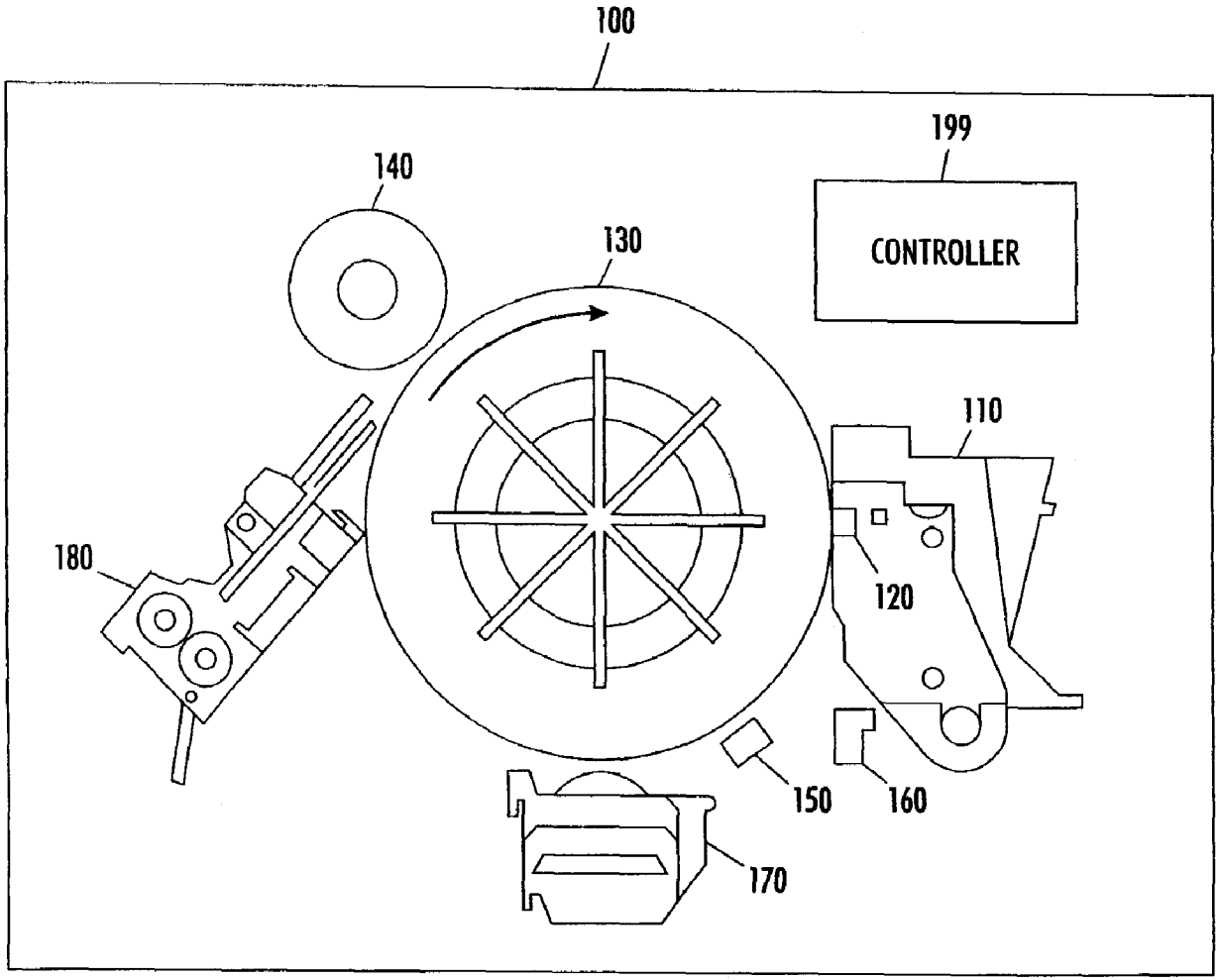
FIG. 1 shows an exemplary embodiment of an inkjet device configured for marking images on the image drum.
Figure 2:
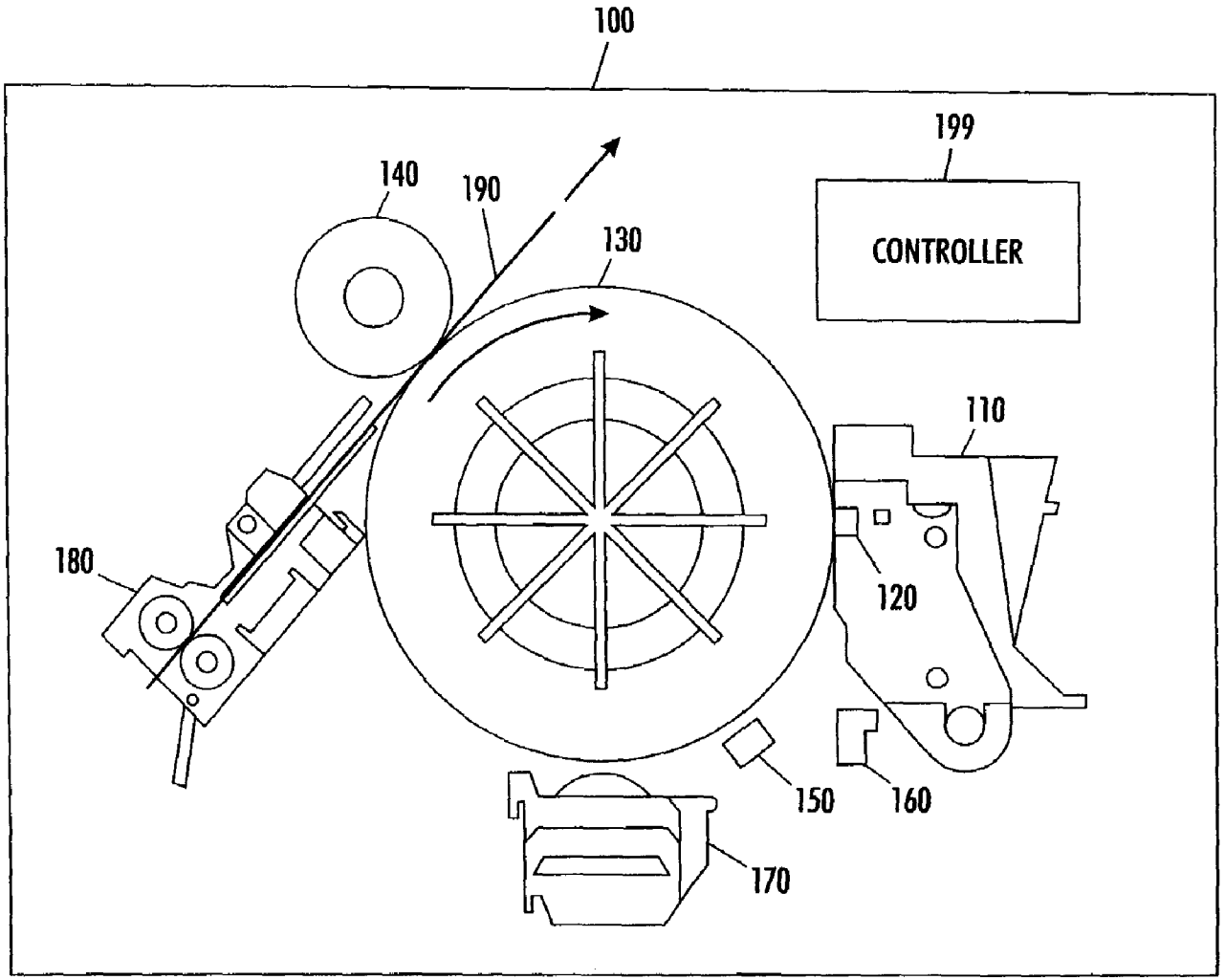
FIG. 2. shows the exemplary inkjet device of FIG. 1 configured to transfer images marked on the drum to media.
Figure 3:
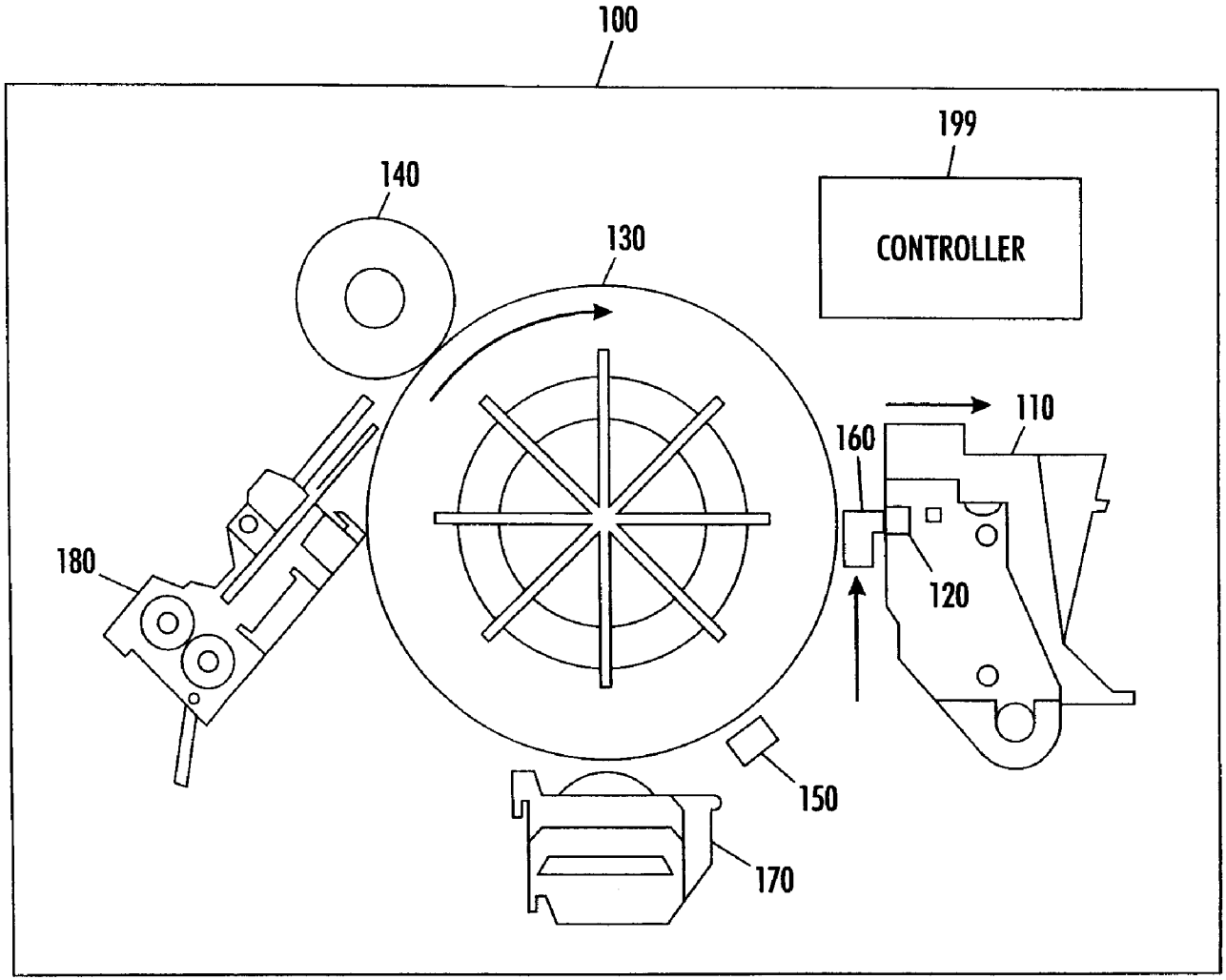
FIG. 3 shows the exemplary inkjet device of FIGS. 1 and 2 configured to perform maintenance on the print head.

For a general understanding of an inkjet device, such as, for example, a solid inkjet printer, an ink-jet printer, or an inkjet facsimile machine, in which the features of this invention may be incorporated, reference is made to FIGS. 1-3. Although the various exemplary embodiments of this invention for detecting inkjet head and inkjet defects are particularly well adapted for use in such a machine, it should be appreciated that the following exemplary embodiments are merely illustrative. Rather, aspects of various exemplary embodiments of this invention may be achieved in any media feed mechanism and/or image reproduction device containing at least one inkjet head with inkjets intended to transfer an image onto an intermediate image substrate.

As shown in FIG. 1, the exemplary inkjet device 100 includes, in part, a print head 110, one or more inkjets 120, an intermediate transfer substrate (intermediate transfer drum 130), a transfer roller 140, an image sensor 150, a print head maintenance unit 160, a drum maintenance unit 170, a media pre-heater 180 that constitutes a portion of the media feed path, and a controller 199. When configured to mark an image on the intermediate transfer drum 130, as shown in FIG. 1, the print head 110, under the control of the controller 199, is positioned in close proximity to the intermediate transfer drum 130. As a result, under the control of the controller 199, the inkjets 120 deposit marking material on the intermediate transfer drum 130 to form an image. While the marking material is being deposited on the intermediate transfer drum 130, the transfer roller 140 is not in contact with the intermediate transfer drum 130.

According to various exemplary embodiments of the invention, a single image may cover the entire intermediate transfer drum 130 (single-pitch). According to various other exemplary embodiments, a plurality of images may be marked on the intermediate transfer drum 130 (multi-pitch). Furthermore, the images may be marked in a single pass (single pass method), or the images may be marked in a plurality of passes (multi-pass method).

When images are marked on the intermediate transfer drum 130 according to the multi-pass method, under the control of the controller 199, a small amount of marking material representing the image is marked by the inkjets 120 during a first rotation of the intermediate transfer drum 130. Then during one or more subsequent rotations of the intermediate transfer drum 130, under the control of the controller 199, marking material representing the same image is laid on top of the original image thereby increasing the total amount of marking material representing the image on the intermediate transfer drum 130.

For example, one type of a multi-pass marking architecture is used to accumulate images from multiple color separations. On each rotation of the intermediate substrate (intermediate transfer drum 130), marking material for one of the color separations (component image) is deposited on the surface of the intermediate transfer drum 130 until the last color separation is deposited to complete the image. Another type of multi-pass marking architecture is used to accumulate images from multiple swaths of the print head 120. On each rotation of the intermediate transfer drum 130, marking material for one of the swaths (component image) is applied to the surface of the intermediate transfer drum 130 until the last swath is applied to complete the image. Both of these examples of multi-pass marking architectures perform what is commonly known as "page printing." Each image composed of the various component images represents a full sheet of media 190 worth of marking material which, as described below, is then transferred from the intermediate transfer drum 130 to the sheet of media 190.

In a multi-pitch marking architecture, the surface of the intermediate substrate (e.g., intermediate transfer drum 130) is partitioned into multiple segments, each segment including a full page image (i.e., a single pitch) and an inter-document zone. For example, a two pitch intermediate transfer drum 130 is capable of marking two images, each corresponding to a single sheet of media 190, during a revolution of the intermediate transfer drum 130. Likewise, for example, a three pitch intermediate transfer drum 130 is capable of marking three images, each corresponding to a single sheet of media 190, during a pass or revolution of the drum.

Once an image or images have been marked on the intermediate transfer drum 130 according to either of the single-pass method or multi-pass method, under the control of the controller 199, the exemplary inkjet device 100 converts to a configuration for transferring the image or images from the intermediate transfer drum 130 onto a sheet of media 190. According to this configuration, shown in FIG. 2, a sheet of media 190 is transported through the media pre-heater 180, under the control of the controller 199, to a position adjacent to and in contact with the intermediate transfer drum 130. When the sheet of media 190 contacts the intermediate transfer drum 130, the transfer roller 140 is re-positioned, under the control of the controller 199, to apply pressure on the back side of the media in order to press the media against the intermediate transfer drum 130 (FIG. 2). The pressure created by the transfer roller 140 on the back side of the sheet of media 190 facilitates the transfer of the marked image from the intermediate transfer drum 130 on to the sheet of media 190.

Due to the rolling of the intermediate transfer drum 130 and the transfer roller 140 (shown by arrows in FIG. 2), the image or images on the intermediate transfer drum 130 is/are transferred onto the sheet of media 190, or sheets of media 190, while the sheet of media 190, or sheets of media 190 are transported through the exemplary inkjet device 100 (in a direction shown by an arrow in FIG. 2).

Note that, as discussed above, when a plurality of images are marked on the intermediate transfer drum 130, the transfer roller 140, under the control of the controller 199, remains in contact with the intermediate transfer drum 130. Thus, if, as is done in xerographic devices, a test image was to be marked in an inter-document zone (a space between two of the plurality of images in a multi-pitch architecture) on the intermediate transfer drum 130, that test image would be disadvantageously transferred onto the transfer roller 140 because no sheet of media 190 would be present to accept the test image. When a sheet of media 190 intended to accept a subsequent image is transported, under the control of the controller 199, into a position adjacent to the intermediate transfer drum 130, the test image on the transfer roller 140 would be deposited on the back side of that sheet of media 190, thereby ruining that sheet of media 190.

Once an image is transferred from the intermediate transfer drum 130 onto a sheet of media 190, as discussed above, the intermediate transfer drum 130 continues to rotate and, under the control of the controller 199, any residual marking material left on the intermediate transfer drum 130 is removed by the drum maintenance unit 170.

When it is determined that print head maintenance is required (i.e., a defect was recognized in an inkjet 120 or print head 110 during a test sequence), the exemplary inkjet device 100, under the control of the controller 199, enters, for example, a print head maintenance mode, shown in FIG. 3. During print head maintenance, under the control of the controller 199, the print head is retracted from the intermediate transfer drum 130 (as shown by an arrow in FIG. 3) and, under the control of the controller 199, a print head maintenance unit 160 is positioned adjacent the inkjets 120. The print head maintenance unit 160, under the control of the controller 199, purges the inkjets 120 to correct any clogged or partially clogged jets. If the print head 110 is misaligned, under the control of the controller 199, jets within the print head may be realigned. If the jet intensity of inkjets within the print head is outside a predetermined range, under the control of the controller 199, the jet intensity of the print head, one or more groups of inkjets within the print head, and/or one or more inkjets may be adjusted.

In order to mitigate the waste of system resources associated with printing a test image and manually inspecting the test image or associated with simply using an IOD, various exemplary embodiments of this invention mark test images on blank portions of the intermediate transfer roller 130, that are embedded within the image sequence. These images are subsequently removed from the intermediate transfer roller 130 prior to their coming in contact with the transfer roller 140. Accordingly, the test images will not ruin sheets of media 190 by being transferred to the transfer roller 140 and onto the back of the sheet of media 190. Further, since the printer is already dedicating system resources to the image sequence, little or no system resources are wasted when marking a test image.

Figure 4:
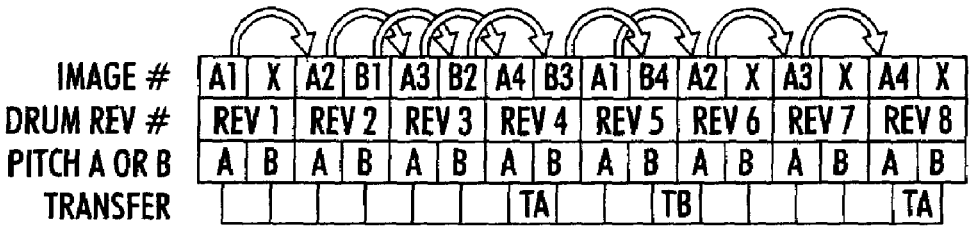
FIG. 4 shows the image transfer cycle for a simultaneous transfer alt-image transfer sequence of a three transfer job.

A first exemplary embodiment of a method for detecting defective inkjet print heads and inkjets according to the invention will be described with reference to FIG. 4. Specifically, FIG. 4 shows the image transfer cycle for a simultaneous transfer alternate image (alt-image) transfer sequence of a three image transfer job using the multi-pass method. As discussed above, according to a multi-pitch architecture, an inkjet device 100 may mark more than one image on the intermediate transfer drum 130. According to this exemplary embodiment, two images may be marked on the intermediate transfer drum 130 prior to being transferred to a sheet of media 190. Also, as discussed above, an inkjet device 100 may lay down an image on the intermediate transfer drum 130 according to the multi-pass method (i.e., marking the same image on top of a previously marked image in order to build up the amount of marking material on the intermediate transfer drum 130).

According to the first exemplary embodiment, the inkjet device 100, under the control of the controller 199, marks two different images A and B on two different portions, pitch A and pitch B of the intermediate transfer drum 130, respectively (i.e., a two-pitch architecture). The inkjet device 100, under the control of the controller 199, marks four component images A1, A2, A3, and A4, and B1, B2, B3, and B4. Each component image represents additional marking material placed on the intermediate transfer drum 130 in order to make up each of the respective images A and B according to the multi-pass method. As discussed above, according to the multi-pass method, an image (A, B) is marked on the intermediate transfer drum 130 by marking a number of component images (A1-A4, B1-B4) on the intermediate transfer drum 130. The component images (A1-A4, B1-B4), when taken together, make up the image (A, B) which will be transferred to the sheet of media 190. According to this exemplary embodiment, the inkjet device 100, under the control of the controller 199, transfers an image A and B to a sheet of media 190 as soon as the final component image A4 or B4 is marked on the intermediate transfer drum 130 (i.e., simultaneous transfer).

The inkjet device 100 according to the first exemplary embodiment also utilizes alt-image sequencing. Alt-image sequencing intentionally offsets the marking of component images by at least one revolution of the intermediate transfer drum 130. Thus, as shown in FIG. 4, a first component image A1 of the first image A is marked, under the control of the controller 199, on a first portion (pitch A) of the intermediate transfer drum 130 during the first revolution Rev 1 of the intermediate transfer drum 130. Then, instead of marking a first component image B1 of the second image B on a second portion (pitch B) of the intermediate transfer drum 130 during the first revolution Rev 1, pitch B, under the control of the controller 199, is allowed to pass by without being marked upon (designated by an "X" in FIG. 4). Accordingly, under the control of the controller 199, the intermediate transfer drum 130 has made one revolution Rev 1 and only a single component image A1 is marked on pitch A of the intermediate transfer drum 130.

Next, during a first part of the second revolution Rev 2 of the intermediate transfer drum 130, a second component image A2 is marked, under the control of the controller 199, on pitch A. Then, during the second part of the second revolution Rev 2, the first component image B1 of the second image B is marked, under the control of the controller 199, on pitch B. Thus, the second image B is offset from the first image A by one revolution of the intermediate transfer drum 130. Accordingly, as discussed below, the transfer of image A (TA) from the intermediate transfer drum 130 to a sheet of media 190 occurs, under the control of the controller 199, one full revolution of the intermediate transfer drum 130 before the transfer of image B (TB) from the intermediate transfer drum 130 to a sheet of media 190.

Alternate image sequencing is described in detail in U.S. Patent Publication 2003/012835 A1, which is herein incorporated by reference in its entirety.

It should be appreciated that in each of FIGS. 4-9, the image transfers (TA, TB) are slightly offset from the images being marked. This is because, according to the design of many inkjet devices 100, the image transfer occurs at the transfer roller 140 which is located adjacent to a separate portion of the intermediate transfer drum 130 than the print head 110. For the purpose of FIGS. 4-9, it is assumed that images are transferred at some point between 0 and 180 degrees (e.g., 90°) from the print head 110 in the direction that the intermediate transfer drum 130 rotates. It should be noted that this is slightly different than the architecture shown in FIGS. 1-3 wherein the images are transferred at about 135° from the print head 110 in the direction that the intermediate transfer drum 130 rotates.

The offset between the images A and B allows the various sheets of media 190 transported through the inkjet device 100 to be spaced apart from one another by a distance equal to, for example, one revolution of the intermediate transfer drum 130. Otherwise, if the images A and B were not offset, the sheets of media 190 would need to be consecutively transported between the intermediate transfer drum 130 and the transfer roller 140 in order for both images A and B to be transferred within the same revolution of the intermediate transfer drum 130 (see e.g., FIG. 7). In some inkjet devices, this can limit the speed with which media can be transported through the device.

As shown in FIG. 4, the fourth component image A4 of the first image is marked, under the control of the controller 199, on the intermediate transfer drum 130 on pitch A of the fourth revolution Rev 4 of the intermediate transfer drum 130. Once the fourth component image A4 is marked, under the control of the controller 199, a sheet of media 190 is advanced between the intermediate transfer drum 130 and the transfer roller 140, and, under the control of the controller 199, the transfer roller 140 applies pressure to the back side of the sheet of media 190. Accordingly, image A is transferred to the sheet of media 190. While pitch A of the intermediate transfer drum 130 is facing the sheet of media 190 to transfer image A onto the sheet of media 190, under the control of the controller 199, the print head 110 is marking the third component image B3 onto pitch B of the intermediate transfer drum 130.

Then, during the fifth revolution Rev 5 of the intermediate transfer drum 130, a first component image A1 of another image A (i.e., the third image in this example) is marked, under the control of the controller 199, on pitch A. Also during the fifth revolution Rev 5, under the control of the controller 199, the fourth component image B4 of image B is marked on the intermediate transfer drum 130. Once the fourth component image B4 is marked, a sheet of media 190 is advanced, under the control of the controller 199, between the intermediate transfer drum 130 and the transfer roller 140, and the transfer roller 140, under the control of the controller 199, applies pressure to the back side of the sheet of media 190 (e.g., FIG. 2). Accordingly, image B is transferred to the sheet of media 190 during the end of the fifth revolution Rev 5 and the beginning of the sixth revolution Rev 6 of the intermediate transfer drum 130. While pitch B of the intermediate transfer drum 130 is facing the sheet of media 190 to transfer image B onto the sheet of media 190, the print head 110, under the control of the controller 199, is marking the second component image A2 onto pitch A of the intermediate transfer drum 130.

As shown in FIG. 4, due to the offset between the images created by skipping pitch B during the first revolution Rev 1 of the intermediate transfer drum 130, the sheets of media 190 receiving images A and B are essentially separated by the fifth revolution Rev 5 of the intermediate transfer drum 130. Thus, the sheets of media 190 do not need to be transported between the intermediate transfer drum 130 and the transfer roller 140 consecutively, thereby limiting the media transport speed of the device.

Once image B has been transferred to the sheet of media 190, component images A3 and A4 are marked, under the control of the controller 199, on pitch A of the intermediate transfer drum 130 during the respective seventh revolution Rev 7 and the eighth revolution Rev 8 of the intermediate transfer drum 130. Also, during the eighth revolution Rev 8 image A is transferred, under the control of the controller 199, onto a sheet of media 190. As shown in FIG. 4 when an inkjet device 100 utilizes a simultaneous transfer alt-image transfer sequence, there are a number of blank pitches X that occur at the beginning and end of the sequence. For example, in FIG. 4, there is a blank pitch X on pitch B of the first revolution Rev 1 caused by the image offset. Also, there are blank pitches X on pitch B of the sixth revolution Rev 6, the seventh revolution Rev 7, and the eighth revolution Rev 8 of the intermediate transfer drum 130 since only an image A is being marked and transferred during those revolutions.

According to the first exemplary embodiment, test images may be marked on these blank pitches and evaluated by the image sensor 150 to measure any defects (clogs and/or misalignments) of the inkjets 120 and/or print head 110. Based on the measurements, the controller 199 can self-adjust the alignment of the inkjets 120 and/or print head 110 and/or initiate a print head maintenance cycle (see FIG. 3).

For example, according the first exemplary embodiment, under the control of the controller 199, a test image could be marked on pitch B of the intermediate transfer drum 130 during the first revolution Rev 1 of the intermediate transfer drum 130. After the image is marked, under the control of the controller 199, pitch B will rotate such that the test image will pass the image sensor 150. The image sensor 150, under the control of the controller 199, will read and evaluate the test image and determine whether any inkjet 120 or print head 110 maintenance and/or realignment is necessary. Just after the test image is read by the image sensor 150, under the control of the controller 199, the test image can be cleaned off of the intermediate transfer drum 130 by the drum maintenance unit 170. Thus, pitch B will be blank and capable of accepting the first component image B1 on the subsequent revolution Rev 2.

It should be appreciated that during a simultaneous transfer alt-image transfer sequence, there will always be at least one blank pitch during the first one or more revolutions of the intermediate transfer drum 130 as a result of the image offset. In various other exemplary embodiments, image B may be offset from image A by more than one revolution in order to further space apart the transported sheets of media 190. Thus, according to those embodiments, there will be additional blank pitches at the beginning of the sequence capable of accepting test images.

Furthermore, as shown in FIG. 4, there are a number of blank pitches X at the end of the sequence. These blank pitches X are the result of the sequence including an odd number of images (i.e., three). Thus, a test image may also be marked, under the control of the controller 199, in one or more of the blank pitches X at the end of the sequence as well. It should be appreciated that when the sequence includes an even number of images, there will be at least one blank pitch at the end of the sequence. For example, assume that, according to the first exemplary embodiment, there were only two images in the sequence. Pitch A of the fifth revolution Rev 5 and pitch A of the sixth revolution Rev 6 would be blank because component images A1 and A2 of the third image would be unnecessary. Thus, even during a sequence including an even number of images a test image may be laid, under the control of the controller 199, on a blank pitch X of the intermediate transfer drum 130 and read and evaluated by the image sensor 150 during the end of sequence.

According to the first exemplary embodiment, by marking test images on the blank pitches X within the image sequence of a print job, the waste of system resources (i.e., dedicated only to the test) is limited. This is because, for example, the intermediate transfer drum 130 is already rotating, since at least one component image has already been marked on the intermediate transfer drum 130. The print head 110 is already configured to mark, since at least one component image has already been marked on the intermediate transfer drum 130. No additional time will be added to a sequence since the pitch utilized for the test image would otherwise have been blank and thus no additional pitches will be added to the sequence. Finally, the electricity required to mark the test image will be substantially the same, the only increase being that necessary to operate the image sensor 150.

Furthermore, according to the first exemplary embodiment, user resources will not be substantially required to measure any defects of the inkjets 120 and/or print head 110. Because the test image is marked on the intermediate transfer drum 130, read by the image sensor 150, and evaluated by the controller 199, it is unnecessary for a user to be present to initiate the test image or evaluate the test image.

Accordingly, if one of the test images is evaluated by the controller 199 and the controller 199 determines that one or more inkjets 120 or print heads 110 are defective, then, under the control of the controller 199, the marking operation may be paused or terminated and print head maintenance and/or realignment may be performed.

It should be appreciated that it is particularly advantageous to mark test images on blank pitches X at the beginning of an image sequence. If the image sequence is large and there is a defective ink jet 110 and/or print head 120, the defect will be detected before a substantial amount of images are marked and transferred to sheets of media 190. Typically, when a substantial amount of images are marked and transferred to sheets of media 190 using a defective ink jet 110 and/or print head 120, all of the resources utilized to mark and transfer the images will be wasted since the images will reflect the defects of the defective ink jet 110 and/or print head 120.

Figure 5:
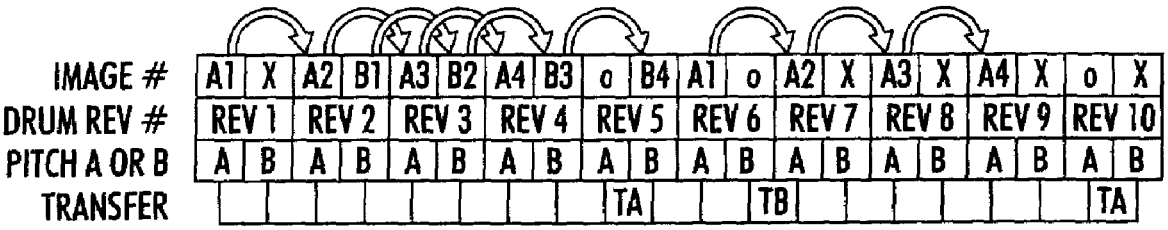
FIG. 5 shows the image transfer cycle for a sequential transfer alt-image transfer sequence of a three transfer job.

FIG. 5 shows a second exemplary embodiment of a method for detecting defective inkjet print heads according to the invention. Specifically, FIG. 5 shows the image transfer cycle for a sequential transfer alt-image transfer sequence of a three image transfer job. Many of the elements and advantages of the second exemplary embodiment are similar to the first exemplary embodiment. Thus, only those portions of the second exemplary embodiment that are different from the first exemplary embodiment will be described.

The second exemplary embodiment utilizes a sequential transfer alt-image transfer sequence rather than a simultaneous transfer alt-image transfer sequence. As shown in FIG. 5, instead of transferring an image from the intermediate transfer drum 130 to a sheet of media 190 in the same revolution (although slightly offset as described above) in which the final component image of that image was marked on the intermediate transfer drum 130, under the control of the controller 199, one or more revolutions are allowed to pass before the image is transferred to the sheet of media 190.

This sequence may be preferable over that of the first exemplary embodiment because sometimes it is desirable to transfer an image to a sheet of media at a different speed than that at which the image is marked on the intermediate transfer drum 130. The additional rotation of the intermediate transfer drum 130 allows the intermediate transfer drum 130 to change speed. Furthermore, in many inkjet devices 100, the transfer roller 120 has a relatively large mass. Thus, transferring an image in a revolution following the revolution in which the final component image of that image was marked on the intermediate transfer drum 130 provides extra time to shift the transfer roller 120 from a state in which it is disengaged from the intermediate transfer drum 130 (e.g., FIG. 1) to a state in which it is engaged with the intermediate transfer drum 130 (e.g., FIG. 2).

As a result of this sequence when one revolution is allowed to pass, as shown in FIG. 5, a component image is not marked on pitch A during the fifth revolution Rev 5 of the intermediate transfer drum 130, pitch B during the sixth revolution Rev 6 of the intermediate transfer drum 130, or pitch A of the tenth revolution Rev 10 of the intermediate transfer drum 130. However, these pitches (indicated by an "o") may not be used to mark test images since the complete images A and B remain on the pitches and have not been transferred to the sheets of media 190.

When only one revolution is allowed to pass, as shown in FIG. 5, the intermediate transfer drum 130 is permitted to transfer an image at a different speed. However, the marking of the next component image (e.g., component image B4 in the fifth revolution Rev 5 of the intermediate transfer drum 130) must occur at that different speed as well. Thus, in various exemplary embodiments it may be preferable to skip marking on more than one revolution of the intermediate transfer drum 130 in order to allow an image to transfer completely, at a transfer speed, before the marking of subsequent component images begins, at a marking speed.

Thus, the pitches which may be used for test images according to the second exemplary embodiment are similar to those in the first exemplary embodiment. One or more blank pitches X will exist towards the beginning of the sequence as a result of the images being offset (e.g., pitch B of the first revolution Rev 1). If an odd number of images are included in the sequence, for example three, as shown in FIG. 5, then blank pitches X will exist at the end of the sequence (e.g., pitch B of the seventh revolution Rev 7, eighth revolution Rev 8, ninth revolution Rev 9, and tenth revolution Rev 10). If an even number of images are included in the sequence, for example two, then pitch A on the sixth revolution Rev 6 and the seventh revolution Rev 7 of the intermediate transfer drum 130 would be blank because component images A1 and A2 of the third image would be unnecessary.

As discussed above with respect to the first and second exemplary embodiments, alt-image sequencing only provides blank pitches X at the very beginning and very end of an image sequence. Thus, if a print job is very large (i.e., many images in the sequence), there is no opportunity to test the inkjets 120 or print head 110 for defects in the middle of the print job. Conceivably, one or more inkjets 120 or the print head 110 could become defective during the large job. If there were no opportunity to test the inkjets 120 or the print head 110 during that large job, the portion of the job that was output following the defect would be worthless. Accordingly, the resources utilized to mark that portion of the job would be wasted.

In order to test the inkjets 120 or print head 110 for defects in the middle of a large print job, according to either the first or second exemplary embodiment, it is possible, under the control of the controller 199, to skip marking on one or more pitches during the middle of the job without substantially interrupting the image sequence. Because as few as one pitch may be skipped, the waste of system resources is limited. For instance, the intermediate transfer drum 130 is already rotating, since at least one component image has already been marked on the intermediate transfer drum 130. The print head 110 is already configured to mark, since at least one component image has already been marked on the intermediate transfer drum 130. Negligible time will be added to a print job, since as few as one additional pitch will be added to large image sequence. Finally, the electricity required to mark the test image will be substantially the same, the only increase being that necessary to operate the image sensor 150.

Substantially no user resources will be required to measure any defects of the inkjets 120 and/or print head 110 either. Because the test image is marked on the intermediate transfer drum 130, read by the image sensor 150, and evaluated by the controller, it is unnecessary for a user to be present to initiate or evaluate the test image.

Figure 6:
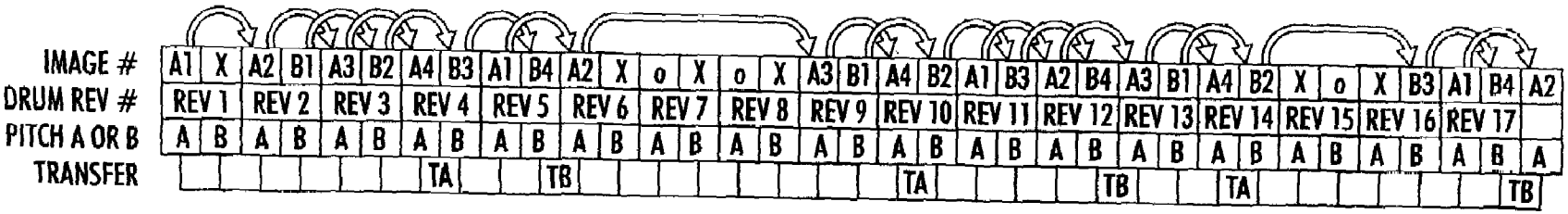
FIG. 6 shows pitch skipping with the image transfer cycle for a simultaneous transfer alt-image transfer sequence.

For example, FIG. 6 shows an example of how pitches may be skipped during a simultaneous transfer alt-image transfer sequence. As shown in FIG. 6, following the transfer of image B on the sixth revolution Rev 6 of the intermediate transfer drum 130, under the control of the controller 199, five pitches beginning with pitch B of the sixth revolution Rev 6 and ending with pitch B of the eighth revolution Rev 8, may be skipped. As discussed above, these skipped pitches result in a number of blank pitches X on which a test image may be marked. It is important to note that, according to this example, only the skipped pitches on pitch B may be used to mark a test image. Because, the pitches were skipped directly after the transfer of image B, pitch B is blank. However, as shown in FIG. 6, because the pitches were skipped after component image A2 was marked on pitch A, the combination of component images A1 and A2 will remain on pitch A during the skipped pitches (indicated by an "o"). Thus, in order for skipped pitches to include at least one blank pitch X, according to the first and second exemplary embodiments, the skipped pitches are skipped directly after an image A or image B is transferred to a sheet of media 190. Furthermore, because the other pitch (which was not just transferred) will contain component images, the odd numbered skipped pitches (i.e., first skipped, third skipped, etc.) are used for test images.

Additionally, according to the first and second exemplary embodiments, when pitches are skipped, an odd number of pitches are skipped. Otherwise, as can be inferred from FIG. 6, a next image intended for pitch A (component image A3) would be marked on pitch B and vice versa. Accordingly, because five pitches are skipped in the example shown in FIG. 6, in revolution nine Rev 9 of the intermediate transfer drum 130, component image A3 is properly marked on pitch A, already containing component images A1 and A2.

FIG. 6 also shows three pitches skipped, under the control of the controller 199, after the transfer of image A after the fourteenth revolution Rev 14 of the intermediate transfer drum 130. Again, note that only the odd skipped pitches (pitch A on Rev 15 and Rev 16) are blank pitches X. The even skipped pitch (pitch B on Rev 15) has component images B1 and B2 marked on it. According to the first and second exemplary embodiments, pitches are skipped following a transfer from a pitch with the smallest number of pitches between it and the previous transfer from that pitch. For example, as shown in FIG. 6, the second group of skipped pitches begins following a transfer from pitch A (e.g., TA on Rev 14) because there are seven pitches between that transfer and the previous transfer from pitch A (TA on Rev 10). Alternatively, there are 13 pitches between the transfer of image B during the thirteenth revolution Rev 13 intermediate transfer drum 130 and image B during the sixth revolution Rev 6 of the intermediate transfer drum 130. This, in effect, results in pitches being skipped following alternating A and B transfers each time a skip is requested.

If, according to the first and second exemplary embodiments, pitches were not skipped following alternating A and B transfers, the image offset between image A and image B would eventually be destroyed, thus defeating the purpose of alt-image sequencing. For example, assume that three pitches were skipped following the transfer of image B TB between the twelfth revolution Rev 12 and the thirteenth revolution Rev 13. On the fifteenth revolution Rev 15, component image B1 would be marked adjacent to component image A1 on the sixteenth revolution, thereby eliminating the image offset.

It should be appreciated that, although for the purpose of explanation, FIG. 6 shows skipped pitches occurring close together within a small job, skipped pitches will typically be significantly spaced apart and used in very large jobs. It should also be appreciated that although FIG. 6 shows pitches skipped within a simultaneous transfer alt-image transfer sequence (first exemplary embodiment), pitches may be skipped within a sequential transfer alt-image transfer sequence (second exemplary embodiment) in the same manner.

Figure 7:
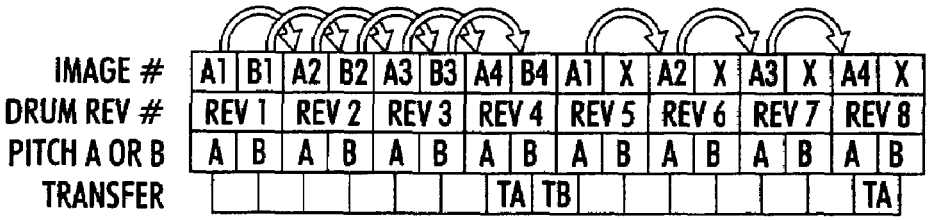
FIG. 7 shows the image transfer cycle for a simultaneous transfer consecutive transfer sequence of a three transfer job.

FIG. 7 shows a third exemplary embodiment of a method for detecting defective inkjet print heads and inkjets according to the invention. Specifically, FIG. 7 shows the image transfer cycle for a simultaneous transfer consecutive transfer sequence of a three image transfer job. As shown in FIG. 7, there is no offset spacing between the marking of the first composite image A1 and the first composite image B1 on the intermediate transfer drum 130. Thus, the images A and B are transferred, under the control of the controller 199, to sheets of media 190 on consecutive pitches, i.e., a single revolution of the intermediate transfer drum 130 (second part of Rev 4 and first part of Rev 5). Sometimes this consecutive transfer sequence is referred to as a "burst" sequence. As discussed above, the two sheets of media 190 which will accept images A and B must be consecutively transported, under the control of the controller 199, through the inkjet device 100 one after another without any space in between. This type of sequence is preferable in some inkjet devices wherein the media transport speed is not affected by the sheets of media 190 having to be consecutively transported (i.e., the speed of the media is limited by some other factor) because the sequence is less complicated.

Because, according to the third exemplary embodiment, there are not any blank pitches X created by image offset, blank pitches X only occur near the end of a job. When the job includes an odd number of images, for example, as shown in FIG. 7, blank pitches X will occur on pitch B of the fifth revolution Rev 5, sixth revolution Rev 6, seventh revolution Rev 7, and eighth revolution Rev 8 of the intermediate transfer drum 130. When the job includes an even number of images, one or more blank pitches X will occur at the end of the sequence. For example, as can be inferred from FIG. 7, if only two images A, B were marked in the sequence, the transfer of the final image (TB at the end of the fourth revolution Rev 4 and the beginning of the fifth revolution Rev 5) would require that the intermediate transfer drum 130 make an additional revolution (Rev 5), or at least part of an additional revolution (Pitch A of Rev 5). Thus, the pitches of that additional revolution (pitches A and B of the fifth revolution Rev 5) or partial revolution (pitch A of the fifth revolution Rev 5) would be blank.

These blank pitches X may be used to mark test images without wasting system or user resources. This is because, for example, the intermediate transfer drum 130 is already rotating, since at least one component image has already been marked on the intermediate transfer drum 130. The print head 110 is already configured to mark, since at least one component image has already been marked on the intermediate transfer drum 130. No additional time will be added to a print job, since the pitch utilized for the test image would otherwise have been blank and thus no additional pitches will be added to the sequence. Finally the electricity required to mark the test image will be substantially the same, the only increase being that necessary to operate the image sensor 150.

Furthermore, according to the third exemplary embodiment, substantially no user resources will be required to measure any defects of the inkjets 120 and/or print head 110. Because the test image is marked on the intermediate transfer drum 130, read by the image sensor 150, and evaluated by the controller, it is unnecessary for a user to be present to initiate or evaluate the test image.

Figure 8:
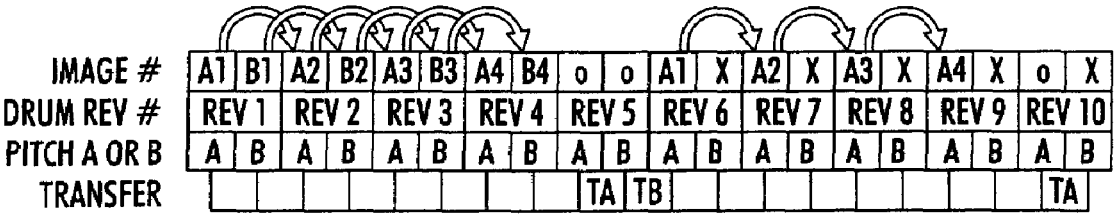
FIG. 8 shows the image transfer cycle for a sequential transfer consecutive transfer sequence of a three transfer job.

FIG. 8 shows a fourth exemplary embodiment of a method for detecting defective inkjets and/or print heads according to the invention. Specifically, FIG. 8 shows the image transfer cycle for a sequential transfer consecutive transfer sequence of a three image transfer job. Many of the elements and advantages of the fourth exemplary embodiment are similar to the third exemplary embodiment. Thus, only those portions of the third exemplary embodiment that are different from the fourth exemplary embodiment will be described.

The fourth exemplary embodiment utilizes a sequential transfer consecutive transfer sequence rather than a simultaneous transfer consecutive transfer sequence. As shown in FIG. 8, instead of transferring an image from the intermediate transfer drum 130 to the sheet of media 190 in the revolution directly following the revolution in which the final component image of that image was marked on the intermediate transfer drum 130, under the control of the controller 199, one or more revolutions of the intermediate transfer drum 130 are allowed to pass before the image is transferred to the sheet of media 190. This sequence may be preferable over the sequence of the third exemplary embodiment for the same reasons discussed above with respect to the second embodiment. As a result, as shown in FIG. 8, under the control of the controller 199, a component image is not marked on pitches A and B during the fifth revolution Rev 5 of the intermediate transfer drum 130, However, these pitches may not be used to mark test images since the complete images A and B remain on the pitches and have not been transferred to the sheets of media 190.

Again, when only one revolution is allowed to pass, as shown in FIG. 8, the intermediate transfer drum 130 is permitted to transfer an image at a different speed. However, the marking of the next component image (e.g., component image A1 in the sixth revolution Rev 6 of the intermediate transfer drum 130) must occur at that different speed as well. Thus, in various exemplary embodiments it may be preferable to skip marking on more than one revolution of the intermediate transfer drum 130 in order to allow an image to transfer completely, at a transfer speed, before the marking of subsequent component images begins, at a marking speed.

Thus, the pitches which may be used for test images according to the fourth exemplary embodiment are similar to those in the third exemplary embodiment. If an odd number of images are included in the sequence, for example three, as shown in FIG. 8, then blank pitches X will exist at the end of the sequence (e.g., pitch B of the sixth revolution Rev 6, seventh revolution Rev 7, eighth revolution Rev 8, ninth revolution Rev 9, and tenth revolution Rev 10). If an even number of images are included in the sequence, the one or more blank pitches will be at the end of the sequence.

In order to test the inkjets 120 or print head 110 for defects in the beginning or middle of a large print job, according to either the third or fourth exemplary embodiment, it is possible to skip marking on one or more pitches during the beginning or middle of the sequence without substantially interrupting the image sequence. Because as few as one pitch may be skipped, the waste of system resources is limited. For instance, the intermediate transfer drum 130 is already rotating, since at least one component image has already been marked on the intermediate transfer drum 130. The print head 110 is already configured to mark, since at least one component image has already been marked on the intermediate transfer drum 130. Negligible time will be added to a print job, since as few as one additional pitch must be added to a large image sequence. Finally, the electricity required to mark the test image will be substantially the same, the only increase being that necessary to operate the image sensor 150.

Furthermore, as discussed above, by skipping pitches at the beginning of an image sequence if the image sequence is large and there is a defective ink jet 110 and/or print head 120, because the defect will be detected before a substantial amount of images are marked and transferred to sheets of media 190. Typically, when a substantial amount of images are marked and transferred to sheets of media 190 using a defective ink jet 110 and/or print head 120, all of the resources utilized to mark and transfer the images will be wasted since the images will reflect the defects of the defective ink jet 110 and/or print head 120

Substantially no user resources will be required to measure any defects inkjets 120 and/or print head 110. Because the test image is marked on the intermediate transfer drum 130, read by the image sensor 150, and evaluated by the controller, it is unnecessary for a user to be present to evaluate the test image.

Figure 9:
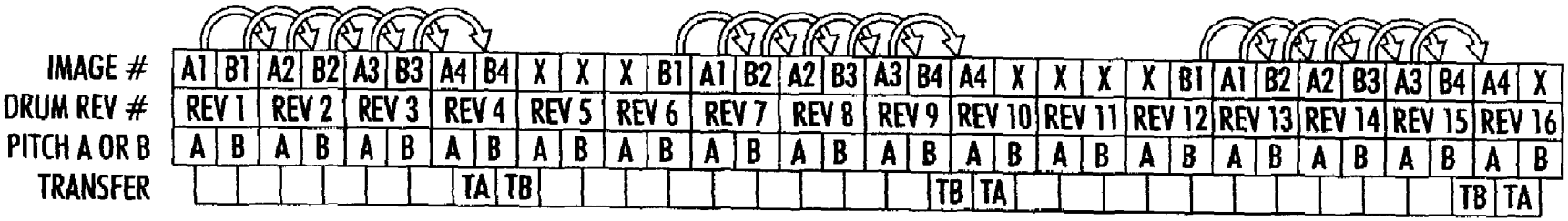
FIG. 9 shows pitch skipping with the image transfer cycle for a simultaneous transfer consecutive image transfer sequence.

For example, FIG. 9 shows an example of skipped pitches in a simultaneous transfer consecutive transfer sequence. As shown in FIG. 9, it is possible to skip one or more pitches following the transfers of images A and B. The pitches are skipped, under the control of the controller 199, following the transfers of images A and B to ensure that at least one of pitch A and B will be blank. However, because images A and B are consecutively transferred, both pitch and A and B are blank. If, under the control of the controller 199, an even number of pitches are skipped, then the order of the component images being marked on the pitches A and B will remain the same (i.e., A before B). For example, as shown in FIG. 9, under the control of the controller 199, four pitches are skipped beginning with pitch B on the tenth revolution Rev 10 of the intermediate transfer drum 130 and ending with pitch A on the twelfth revolution Rev 12 of intermediate transfer drum 130. Because, as discussed above, both image A and image B were transferred prior to the pitches being skipped, all of the four skipped pitches are blank pitches X which may be used for test images.

If however, under the control of the controller 199, an odd number of pitches are skipped, then the order of the component images being marked on pitches A and B will reverse. For example, as shown in FIG. 9, under the control of the controller 199, three pitches are skipped beginning with pitch A on the fifth revolution Rev 5 of the intermediate transfer drum 130 and ending with pitch A on the sixth revolution Rev 6 of intermediate transfer drum 130. Again, because both image A and image B were transferred prior to the pitches being skipped all of the three skipped pitches are blank pitches X which may be used for test images.

It should be appreciated that when an odd number of pitches are skipped according to the third or fourth exemplary embodiments, the order in which the component images are marked is reversed. For example, as shown in FIG. 9, after the three blank pitches X are skipped, the component images are marked, under the control of the controller 199, beginning with pitch B rather than pitch A. Thus, under the control of the controller 199, image B will be transferred to a sheet of media 190 before image A. Therefore, when an odd number of pitches are skipped the overall image order may be occasionally reversed. For example, as shown in FIG. 9, the first image of the image sequence will be marked on pitch A, the second image will be marked on pitch B, and after an odd number of pitches are skipped, the third image will be marked of pitch B. Otherwise the output of the image sequence would be out of order.

It should be appreciated that, although for the purpose of explanation, FIG. 9 shows skipped pitches occurring close together within a small job, skipped pitches will typically be significantly spaced apart and used in very large jobs. It should also be appreciated that although FIG. 9 shows pitches skipped within a simultaneous transfer consecutive transfer sequence (third exemplary embodiment), pitches may be skipped within a sequential transfer consecutive transfer sequence (fourth exemplary embodiment) in the same manner.

It should be appreciated that, although for ease of explanation, the above-described exemplary embodiments are described with respect to images marked on an intermediate substrate (e.g., intermediate transfer drum 130) according to the multi-pass method including four component images, various other exemplary embodiments may utilize the multi-pass method including more or less than four component images or single-pass method. Furthermore, according to various other exemplary embodiments, the intermediate substrate (e.g., intermediate transfer drum 130) may include more than two pitches.

As discussed above, with respect to each of the four exemplary embodiments, it is possible that, as a result of the image sequence, a blank pitch X will exist at the end of an image sequence, following the final transfer of an image A, B (see, e.g., FIG. 4, Rev 8, pitch B; FIG. 5, Rev 10, pitch B; FIG. 7, Rev 8, pitch B; FIG. 8, rev 10, pitch B; and FIG. 9, Rev 16, pitch B). According to various exemplary embodiments of this invention these blank pitches X at the end of the sequence are used to mark test images. If a blank pitch near the end of the sequence, but not at the end of the sequence is used to mark the test image, the test image will be marked at the same speed at which component images are marked.

However, if the test image is marked at the end of the job it can be marked at the transfer speed of the intermediate transfer drum 130, rather than the marking speed. Typically, the transfer speed is slower than the marking speed. The slower speed allows for a precise test image to be marked. Furthermore, because the test image is marked on the intermediate transfer drum 130 at the end of the sequence and, i.e., no more images need to be marked or transferred, the speed of the intermediate transfer drum 130 may be adjusted to a speed optimized to allow the image sensor 150 to read the test image.

Furthermore, even if according to the image sequence no blank pitch X exists at the end of an image sequence, the transfer of the final image according to any of the above sequences, will occur part of the way into a blank pitch. For example assume that in FIG. 7, only two images A and B are transferred to a sheet of media 190. Thus, when image B is being transferred to the second sheet of media 190 at the end of the fourth revolution Rev 4 of the intermediate transfer drum 130, pitch A of the beginning of the fifth revolution Rev 5 of the image drum 130 (which would be blank since component image A1 would not be marked) will be passing the print head 110. Thus, in order to print a test image on the intermediate transfer drum 130, the intermediate transfer drum 130 will only need to be rotated to finish passing pitch A by the print head 120. Then, as discussed above, because the printing is finished, and substantially no additional resources were expended in the slight additional rotation of the intermediate transfer drum 130 may be rotated at a speed which is optimized to allow the image sensor 150 to read the test image.

Also as discussed above, according to the first and second exemplary embodiments, alternate image sequencing results in a number of blank pitches X at the beginning of an image sequence. Even if alternate imaging is not used, one or more pitches may be skipped near the beginning of an image sequence (see, e.g., FIG. 9). According to various exemplary embodiments of this invention, a test image is marked on a blank pitch X and tested at the beginning of an image sequence when the image sequence is very long. For instance, if an inkjet 120 is defective prior to beginning a long image sequence, every image marked and transferred prior to that defect inkjet 120 being detected and remedied, will be wasted. If the sequence is large, this can result in a substantial waste of resources. Thus, when an image sequence is large, it is advantageous to mark a test image at the beginning of the sequence, even if the intermediate transfer drum 130 has to be slowed down in order for the image to be evaluated by the image sensor 150.

As discussed above, it may be advantageous to change the speed of the intermediate transfer drum 130 in order to evaluate the test image. Ordinarily, slowing down the intermediate transfer drum 130 in the middle of an image sequence would result in the waste of some system resources (i.e., the overall time necessary to complete the image sequence). However, when the image sequence is very large, such a minor increase of time is warranted in light of the substantial wasted resources that might result from beginning a large image sequence with a defective inkjet 120. According to various exemplary embodiments, a test image may be marked on the intermediate transfer drum 130 and evaluated when the total number of images in the sequence is, for example, more than a predetermined limit.

Furthermore, as discussed above, it may be advantageous to skip pitches within large image sequences. When an image sequence is particularly large, and a test image was marked at the beginning of the image sequence, it still might be preferable to mark a test image on the intermediate transfer drum 130 in the middle of the image sequence. For instance, it is conceivable that a print head might become defective after the first image was marked at the beginning of the image sequence, but substantially before the end of the image sequence. If such an inkjet 120 becomes defective, all of the images transferred to sheets of media 190 after the defect will be defective and wasted.

Also as discussed above, according to various exemplary embodiments, it may be advantageous to change the speed of the intermediate transfer drum 130 in order to evaluate the test image with the image sensor 150. Ordinarily, slowing down the intermediate transfer drum 130 in the middle of an image sequence, as a result of evaluating a test image on a skipped pitch would result in the waste of some system resources (i.e., the overall time necessary to complete the image sequence). However, when the image sequence is very large, such a minor increase of time is warranted in light of the substantial wasted resources that might result from beginning a large image sequence with a defective inkjet 120.

Although, for ease of explanation, the above described exemplary embodiments are described within the context of an inkjet device 100 having one print head 120, various other exemplary embodiments may include more than one print head. Furthermore, although, for ease of explanation, the above described exemplary embodiments are described within the context of an inkjet device 100 having one controller 199, various other exemplary embodiments may use more than one controller within the device 100, and/or at least one controller outside the device, such as in a locally or remotely located laptop or personal computer, a personal digital assistant, a tablet computer, a device that stores and/or transmits electronic data, such as a client or a server of a wired or wireless network, an intranet, an extranet, a local area network, a wide area network, a storage area network, the Internet (especially the World Wide Web), and the like. In general, the one or more controllers may be in any known or later-developed source that is capable of providing control signals to an inkjet device.

Although the above-described consecutive image sequence exemplary embodiments have been described with respect to indirect marking architecture (i.e., first marking on an intermediate substrate prior to transferring the image to a sheet of media), various other exemplary embodiments may utilize direct marking architecture (i.e., marking the image directly onto the sheet of media). According to such embodiments, the test images may be written onto the substrate (i.e., sheet of media) on an unused portion of the sheet of media. The unused portion of the sheet of media may be a unused portion of a sheet of media, such as, a margin or otherwise unused portion. Furthermore, the unused portion may be an entire sheet of media that is transported through the inkjet device when a sheet of media would not otherwise be transported.

Thus, as discussed above, even when a direct marking architecture is used, the waste of system resources is limited. For instance, the sheets of media are already being transferred through the system. The print head is already configured to mark. Negligible time will be added to a print job, since as few as no additional sheets of media must be added to an image sequence. Finally, the electricity required to mark the test image will be substantially the same, the only increase being that necessary to operate the image sensor. Furthermore, the above-described advantages with respect to marking a test image at the beginning or end of an image sequence apply as well.

While various features of this invention have been described in conjunction with the exemplary embodiments outlined above, various alternatives, modifications, variations, and/or improvements of those features may be possible. Accordingly, the exemplary embodiments of the invention, as set forth above, are intended to be illustrative. Various changes may be made without departing from the spirit and scope of the invention.

What is claimed is:

1. A method for detecting a defect in an inkjet print head, comprising:

marking images on a rotating intermediate substrate according to a consecutive image sequence, wherein the rotating intermediate substrate is divided into two or more portions that are each capable of receiving an image;

marking a test image on at least one blank portion of the intermediate substrate, the blank portion resulting from the consecutive image sequence, wherein the at least one blank portion comprises at least one of the two or more portions of the rotating intermediate substrate when one of the two or more portions is blank;

evaluating the test image with a sensor, wherein the rotating intermediate substrate rotates and moves the test image on the rotating intermediate substrate so that the test image is adjacent to the sensor; and determining whether the inkjet print head is defective based on the evaluation.

2. The method of claim 1, wherein the at least one blank portion of the rotating intermediate substrate results from the consecutive image sequence.

3. The method of claim 1, wherein:

marking the test image on the at least one blank portion of the rotating intermediate substrate comprises marking the test image on the blank portion of the rotating intermediate substrate at a speed in which a marked image is transferred to a sheet of media; and evaluating the test image with a sensor comprises evaluating the image at an end of the consecutive image sequence at a rotation speed at a different speed than that in which the marked image is transferred to the sheet of media.

4. The method of claim 3, wherein marking the test image on at least one blank portion of the rotating intermediate substrate comprises marking the test image while transferring a final marked image to a sheet of media.

5. The method of claim 1, wherein marking images on the rotating intermediate substrate according to the consecutive image sequence comprises:

marking one or more component images of a first image on a first portion of the rotating intermediate substrate, each of the one or more component images of the first image marked on the first portion during a different rotation of the rotating intermediate substrate; and marking one or more component images of a second image on a second portion of the rotating intermediate substrate, each of the one or more component images of the second image marked on the second portion during a different rotation of the rotating intermediate substrate;

wherein the first image is transferred onto a first sheet of media and the second image is transferred onto a second sheet of media during a same rotation of the intermediate substrate.

6. The method of claim 5, further comprising:

skipping marking on the at least one blank portion of the rotating intermediate substrate; and marking the test image on at least one of the skipped the at least one blank portion of the rotating intermediate substrate.

7. The method of claim 6, wherein skipping marking on the at least one blank portion of the rotating intermediate substrate comprises skipping marking on at least one of the two or more portions of the rotating intermediate substrate, following a transfer of an image from that portion onto a sheet of media.

8. The method of claim 6, wherein skipping marking on the at least one blank portion of the rotating intermediate substrate comprises skipping marking on at least one of the two or more portions of the rotating intermediate substrate, following a transfer of an image from that portion onto a sheet of media.

9. The method of claim 8, wherein marking the test image on the at least one blank portion of the intermediate substrate if the determined number of marked images is more than a predetermined number, comprises marking a test image at the beginning of the alternate image sequence.

10. The method of claim 9, wherein if the evaluation of the test image indicates a defect, the method further comprises:

canceling the consecutive image sequence; and cleaning the intermediate substrate.

11. The method of claim 5, further comprising:

determining, according to the consecutive image sequence, a number of marked images that will be transferred to a sheet of media and that have not yet been transferred to a sheet of media;

wherein, marking the test image on at least one blank portion of the rotating intermediate substrate comprises marking a test image on the at least one blank portion of the rotating intermediate substrate if the determined number of marked images is more than a predetermined number.

12. A system for detecting a defective inkjet print head and inkjets, comprising:

at least one controller that:

causes at least one inkjet to mark images a rotating intermediate substrate according to a consecutive image sequence, wherein the rotating intermediate substrate is divided into two or more portions that are each capable of receiving an image;

causes the at least one inkjet to mark a test image on at least one blank portion of the rotating intermediate substrate, the blank portion resulting from the consecutive image sequence, wherein the at least one blank portion comprises at least one of the two or more portions of the rotating intermediate substrate when one of the two or more portions is blank;

causes a sensor to input the test image, wherein the rotating intermediate substrate rotates and moves the test image on the rotating intermediate substrate so that the test image is adjacent to the sensor; and determines whether at least one of the at least one inkjets is defective based on the input test image.

13. An inkjet device including the system of claim 12.

14. A method for detecting a defect in an inkjet print head, comprising:

marking images on at least one substrate according to a consecutive image sequence, wherein the rotating intermediate substrate is divided into two or more portions that are each capable of receiving an image;

marking, a test image on at least one blank portion of the at least one substrates, the blank portion resulting from the consecutive image sequence, wherein the at least one blank portion comprises at least one of the two or more portions of the rotating intermediate substrate when one of the two or more portions is blank;

evaluating the test image with an electronic sensor, prior to being output, wherein the rotating intermediate substrate rotates and moves the test image on the rotating intermediate substrate so that the test image is adjacent to the sensor; and determining whether the inkjet print head is defective based on the evaluation.

* * * * *